US012297720B2

(12) United States Patent
Al-Mousa et al.

(10) Patent No.: US 12,297,720 B2
(45) Date of Patent: May 13, 2025

(54) DOWNHOLE PERFORATING TOOL SYSTEMS AND METHODS

(71) Applicant: Saudi Arabian Oil Company, Dhahran (SA)

(72) Inventors: Ahmed Al-Mousa, Dhahran (SA); Malik M. Humood, Saihat (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 342 days.

(21) Appl. No.: 17/536,790

(22) Filed: Nov. 29, 2021

(65) Prior Publication Data

US 2023/0167722 A1 Jun. 1, 2023

(51) Int. Cl.
*E21B 43/119* (2006.01)
*E21B 33/124* (2006.01)
*E21B 43/116* (2006.01)

(52) U.S. Cl.
CPC ..... *E21B 43/119* (2013.01); *E21B 33/1243* (2013.01); *E21B 43/116* (2013.01)

(58) Field of Classification Search
CPC ..... E21B 43/114; E21B 33/10; E21B 43/119; E21B 43/116; E21B 33/1243
See application file for complete search history.

(56) References Cited

U.S. PATENT DOCUMENTS 5,697,441 A 12/1997 Vercaemer et al.
5,704,426 A 1/1998 Rytlewski et al.
8,424,611 B2 4/2013 Smith et al.
10,626,698 B2 4/2020 Al-Mousa et al.
10,837,254 B2 11/2020 Al-Mousa et al.
10,975,645 B2 4/2021 Al-Mousa et al.
10,975,654 B1 4/2021 Neacsu et al.
(Continued)

FOREIGN PATENT DOCUMENTS

CA 2624368 4/2011

OTHER PUBLICATIONS

U.S. Appl. No. 17/131,352, Al-Mousa et al., filed Dec. 22, 2020.
(Continued)

*Primary Examiner* — Yong-Suk (Philip) Ro
(74) *Attorney, Agent, or Firm* — Fish & Richardson P.C.

(57) ABSTRACT

A downhole perforation tool includes an upper sub-assembly configured to couple to a downhole conveyance within a wellbore that is formed from a terranean surface toward a subterranean formation; and a plurality of perforation sub-assemblies. Each perforation sub-assembly includes one or more perforation guns, and one or more ports configured to fluidly couple the wellbore with a bore that extends from the one or more ports to the upper sub-assembly. The downhole perforation tool further includes a main wellbore seal positioned between the upper sub-assembly and the plurality of perforation sub-assemblies and actuatable to anchor the downhole perforation tool to a casing in the wellbore. The downhole perforation tool further includes at least one secondary wellbore seal positioned between adjacent perforation sub-assemblies of the plurality of perforation sub-assemblies. The at least one secondary wellbore seal is actuatable to fluidly isolate a portion of an annulus of the wellbore from another portion of the annulus of the wellbore.

20 Claims, 10 Drawing Sheets

(56) References Cited

U.S. PATENT DOCUMENTS

| | | | | |
|---|---|---|---|---|
| 10,982,504 | B2 | 4/2021 | Al-Mousa et al. | |
| 11,008,824 | B2 | 5/2021 | Al-Mousa et al. | |
| 11,035,190 | B2 | 6/2021 | Neascu et al. | |
| 11,105,180 | B2 | 8/2021 | Al-Mousa et al. | |
| 11,136,849 | B2 | 10/2021 | Al-Mousa et al. | |
| 11,142,976 | B2 | 10/2021 | Al-Mousa et al. | |
| 11,156,052 | B2 | 10/2021 | Al-Mousa et al. | |
| 11,225,850 | B2 | 1/2022 | Al-Mousa et al. | |
| 11,230,904 | B2 | 1/2022 | Al-Mousa et al. | |
| 2008/0066912 | A1 | 3/2008 | Freyer et al. | |
| 2015/0041148 | A1* | 2/2015 | Greenan | E21B 34/103 166/374 |
| 2017/0145801 | A1* | 5/2017 | Hazel | E21B 33/1243 |
| 2019/0128098 | A1* | 5/2019 | Ross | E21B 47/06 |
| 2020/0024936 | A1* | 1/2020 | Chang | E21B 43/26 |
| 2020/0056446 | A1 | 2/2020 | Al-Mousa et al. | |
| 2021/0025259 | A1 | 1/2021 | Al-Mousa et al. | |
| 2021/0054708 | A1 | 2/2021 | Al-Mousa et al. | |
| 2021/0215013 | A1 | 7/2021 | Neacsu et al. | |
| 2021/0230960 | A1 | 7/2021 | Al-Mousa | |
| 2021/0262296 | A1 | 8/2021 | Al-Mousa et al. | |
| 2021/0262307 | A1 | 8/2021 | Neacsu | |
| 2021/0293094 | A1 | 9/2021 | Al-Mousa et al. | |
| 2021/0293135 | A1 | 9/2021 | Al-Mousa et al. | |
| 2021/0363839 | A1 | 11/2021 | Al-Mousa et al. | |
| 2022/0042389 | A1 | 2/2022 | Al-Mousa et al. | |
| 2022/0042390 | A1 | 2/2022 | Al-Mousa et al. | |

OTHER PUBLICATIONS

U.S. Appl. No. 17/140,298, Al-Mousa et al., filed Jan. 4, 2021.
U.S. Appl. No. 17/144,824, Al-Mousa et al., filed Jan. 8, 2021.
U.S. Appl. No. 17/188,870, Al-Mousa, filed Mar. 1, 2021.
U.S. Appl. No. 17/237,822, Al-Mousa et al., filed Apr. 22, 2021.
U.S. Appl. No. 17/246,904, Al-Mousa et al., filed May 3, 2021.
U.S. Appl. No. 17/323,632, Al-Shaiji et al., filed May 18, 2021.
U.S. Appl. No. 17/329,991, Madan et al., filed May 25, 2021.
U.S. Appl. No. 17/374,505, Al-Mousa et al., filed Jul. 13, 2021.
U.S. Appl. No. 17/405,362, Al-Mousa, filed Aug. 18, 2021.
U.S. Appl. No. 17/510,027, Al-Mousa, filed Oct. 25, 2021.
U.S. Appl. No. 17/549,420, Al-Mousa, filed Dec. 13, 2021.
U.S. Appl. No. 17/648,082, Al-Mousa, filed Jan. 14, 2022.

* cited by examiner

DOWNHOLE PERFORATING TOOL SYSTEMS AND METHODS

TECHNICAL FIELD

The present disclosure describes apparatus, systems, and methods for a downhole perforating tool.

BACKGROUND

Hydrocarbon production, such as production of oil and gas, from subterranean reservoirs often utilize perforating tools to create perforations in a casing to enhance production. For instance, some operations in drilling and workover wells utilize running perforation guns into a wellbore to provide effective flow communication between a cased wellbore and productive reservoir. However, a limitation of perforation guns and tools used to operate such guns is the ability to control or isolate a flow of hydrocarbons into the wellbore once the perforations are made.

SUMMARY

In an example implementation, a downhole perforation tool includes an upper sub-assembly configured to couple to a downhole conveyance within a wellbore that is formed from a terranean surface toward a subterranean formation; a plurality of perforation sub-assemblies, where each perforation sub-assembly includes one or more perforation guns, and one or more ports configured to fluidly couple the wellbore with a bore that extends from the one or more ports to the upper sub-assembly; a main wellbore seal positioned between the upper sub-assembly and the plurality of perforation sub-assemblies, the main wellbore seal actuatable to anchor the downhole perforation tool to a casing in the wellbore; and at least one secondary wellbore seal positioned between adjacent perforation sub-assemblies of the plurality of perforation sub-assemblies, the at least one secondary wellbore seal actuatable to fluidly isolate a portion of an annulus of the wellbore from another portion of the annulus of the wellbore.

In an aspect combinable with the example implementation, the plurality of perforation sub-assemblies include at least three perforation sub-assemblies.

In another aspect combinable with any of the previous aspects, the at least one secondary wellbore seal includes a first secondary wellbore seal positioned between a first pair of the at least three perforation sub-assemblies and a second secondary wellbore seal positioned between a second pair of the at least three perforation sub-assemblies.

In another aspect combinable with any of the previous aspects, each of the one or more perforation guns are configured to activate based on an activation signal provided by a stinger tool run into the wellbore.

In another aspect combinable with any of the previous aspects, each perforation sub-assembly includes one or more port covers configured to move between a first position such that the one or more ports is open to the wellbore to fluidly couple the wellbore with the bore and a second position such that the one or more ports is closed to the wellbore to fluidly decouple the wellbore from the bore.

In another aspect combinable with any of the previous aspects, the one or more port covers are configured to move from the first position to the second position based on engagement of one or more sleeves that abuts the one or more port covers with the stinger tool to move the one or more sleeves toward the one or more ports.

In another aspect combinable with any of the previous aspects, the one or more port covers is biased toward the first position by one or more springs.

In another aspect combinable with any of the previous aspects, the one or more sleeves includes a profile configured to engage a key on the stinger tool.

In another aspect combinable with any of the previous aspects, the key on the stinger tool is biased by a spring to engage the profile.

In another aspect combinable with any of the previous aspects, the one or more secondary wellbore seals includes a packer.

In another aspect combinable with any of the previous aspects, the main wellbore seal includes an inflatable packer.

In another example implementation, a method includes running a downhole perforation tool into a wellbore formed from a terranean surface toward a subterranean formation on a downhole conveyance coupled to an upper sub-assembly of the downhole perforation tool, where the downhole perforation tool includes a plurality of perforation sub-assemblies. Each perforation sub-assembly includes one or more perforation guns, and one or more port. The method further includes positioning the downhole perforation tool at a particular depth in the wellbore with the downhole conveyance; actuating a main wellbore seal positioned between the upper sub-assembly and the plurality of perforation sub-assemblies to anchor the downhole perforation tool to a casing in the wellbore at the particular depth; activating the one or more perforation guns to form one or more perforations in the casing; actuating at least one secondary wellbore seal positioned between adjacent perforation sub-assemblies of the plurality of perforation sub-assemblies to fluidly isolate a portion of an annulus of the wellbore from another portion of the annulus of the wellbore; and receiving a flow of a hydrocarbon fluid through the one or more ports and into a bore that extends from the one or more ports to the upper sub-assembly.

In an aspect combinable with the example implementation, the plurality of perforation sub-assemblies include at least three perforation sub-assemblies, and the at least one secondary wellbore seal includes a first secondary wellbore seal positioned between a first pair of the at least three perforation sub-assemblies and a second secondary wellbore seal positioned between a second pair of the at least three perforation sub-assemblies.

Another aspect combinable with any of the previous aspects further includes actuating the first and second secondary wellbore seals; and receiving the flow of the hydrocarbon fluid through the one or more ports of each of the at least three perforation sub-assemblies into the bore.

In another aspect combinable with any of the previous aspects, activating the one or more perforation guns includes activating each of the one or more perforation guns are configured to activate based on an activation signal provided by a stinger tool run into the wellbore and coupled to the downhole perforation tool.

In another aspect combinable with any of the previous aspects, each perforation sub-assembly includes one or more port covers.

Another aspect combinable with any of the previous aspects further includes moving the one or more port covers between a first position such that the one or more ports is open to the wellbore to fluidly couple the wellbore with the bore and a second position such that the one or more ports is closed to the wellbore to fluidly decouple the wellbore from the bore.

In another aspect combinable with any of the previous aspects, moving the one or more port covers includes engaging one or more sleeves that abuts the one or more port covers with the stinger tool; and moving the one or more sleeves toward the one or more ports with the stinger tool to move the one or more port covers from the first position to the second position.

In another aspect combinable with any of the previous aspects, the one or more port covers is biased toward the first position by one or more springs.

In another aspect combinable with any of the previous aspects, engaging the one or more sleeves with the stinger tool includes engaging a profile of the one or more sleeves with a key on the stinger tool.

In another aspect combinable with any of the previous aspects, the key on the stinger tool is biased by a spring to engage the profile.

In another aspect combinable with any of the previous aspects, the one or more secondary wellbore seals includes a packer.

In another aspect combinable with any of the previous aspects, actuating the main wellbore seal includes inflating the main wellbore seal.

Implementations of a downhole perforating tool system according to the present disclosure may include one or more of the following features. For example, a downhole perforating tool system according to the present disclosure can save rig time by allowing a single run to perforate and isolate, rather than using a dedicated perforation run in combination with and using cement for plugging the perforation that requires a rig operator and full cement unit. As another example, a downhole perforating tool system according to the present disclosure can eliminate the use of cement as an isolation mechanism to stop unwanted flow of hydrocarbon production. For example, a downhole perforating tool system according to the present disclosure can provide for isolation in a single perforation stage or section, as well as a multiple perforation stages or sections.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
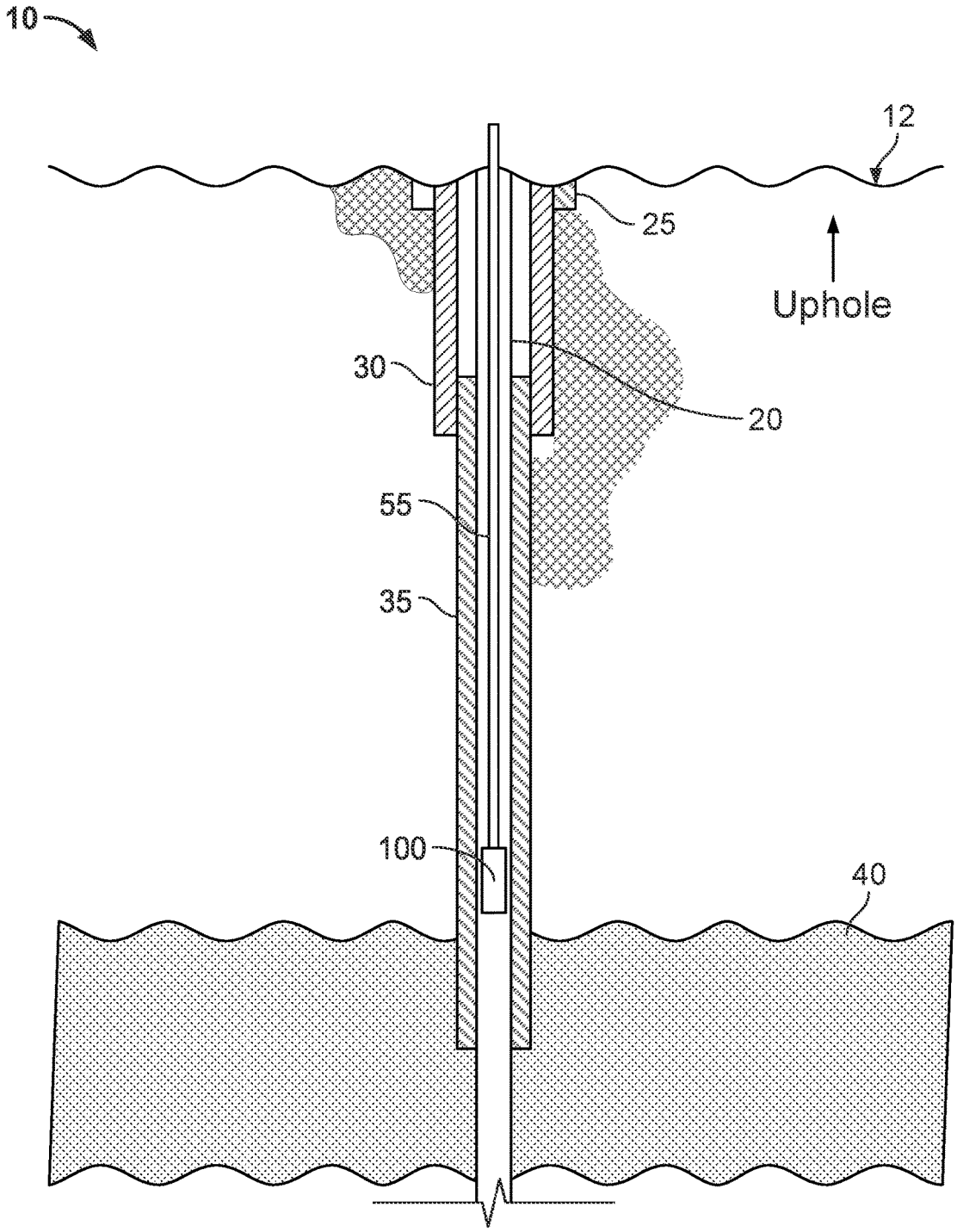
FIG. 1 is a schematic diagram of a wellbore system that includes an example implementation of a downhole perforation tool according to the present disclosure.

FIG. 1 is a schematic diagram of wellbore system 10 that includes a downhole perforation tool 100 according to the present disclosure. Generally, FIG. 1 illustrates a portion of one embodiment of a wellbore system 10 according to the present disclosure in which the downhole tool 100, as a downhole perforation tool 100, may be run into a wellbore 20 and activated at a particular downhole position (or positions) within a wellbore tubular within the wellbore 20. Generally, the downhole perforation tool 100 can be activated to selectively fire one or more perforating guns to create perforations in the wellbore tubular in order to fluidly couple an interior volume of the tool 100 (as well as the wellbore) with a subterranean reservoir (or formation) 40. The downhole perforation tool 100 can be further activated to selectively actuate one or more wellbore seals (for example, packers or otherwise) to fluidly isolate a portion of the wellbore 20 from another portion of the wellbore 20. The downhole perforation tool 100 can be further activated to selectively open one or more valve assemblies to fluidly couple the tool 100 (and other production tubular equipment in the wellbore 20) with the subterranean formation 40 to produce one or more hydrocarbon (or other) fluids) to a terranean surface 12.

In this example, the downhole perforation tool 100 can be connected to a downhole conveyance 55, such as a drill pipe or other work string that is comprised of multiple, threaded tubulars. In some alternative aspects, the downhole conveyance 55 can be a wireline or slickline conveyance. Thus, the downhole perforation tool 100 is connected to the downhole conveyance 55 during a running in process, a running out process, or during an operations of the downhole perforations tool 100 in the wellbore 20.

As shown, the wellbore system 10 accesses the subterranean formation 40 and provides access to hydrocarbons located in such subterranean formation 40. In an example implementation of system 10, the system 10 may be used for a production operation in which the hydrocarbons may be produced from the subterranean formation 40 within a wellbore tubular 35, for example, as production tubing 35. However, the wellbore tubular 35 can be any tubular member positioned in the wellbore 20 such as any type of casing, a liner or lining, or other form of tubular member.

A drilling assembly (not shown) can be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and production casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the production casing 35. Any of the illustrated casings, as well as other casings or tubulars that may be present in the wellbore system 10, may include one or more casing collars. As shown in FIG. 1, the downhole perforation tool 100 may be run into the wellbore 20. In some aspects, as shown, the downhole perforation tool 100 may be inserted into the wellbore 20, which may be filled with a fluid, such as a drilling fluid or otherwise.

Figure 2A:
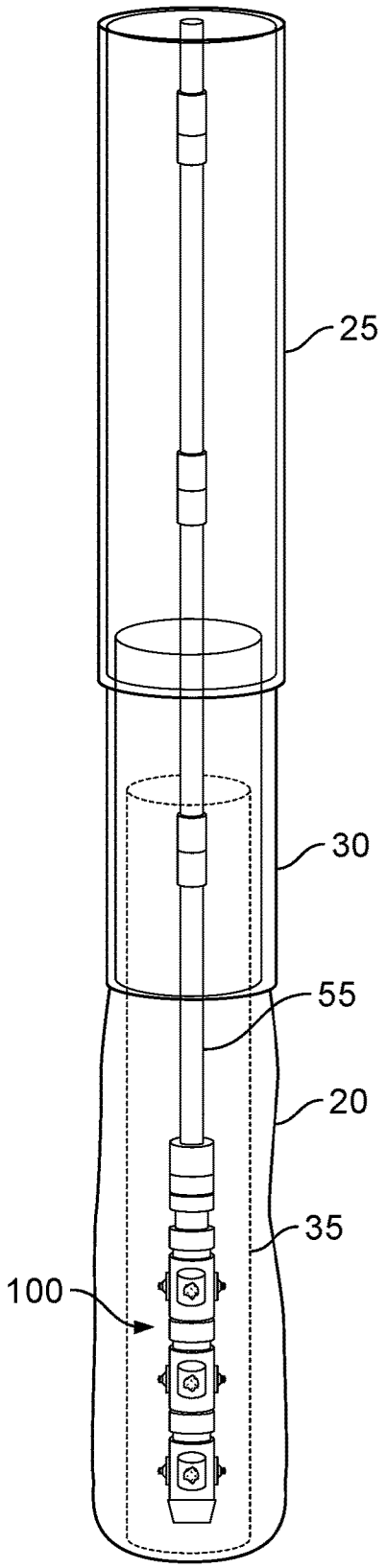
FIGS. 2A-2D are schematic illustrations of a wellbore operation with a downhole perforation tool according to the present disclosure.

Turning now to FIGS. 2A-2D, these figures schematically illustrate a wellbore operation with the downhole perforation tool 100 according to the present disclosure. FIG. 2A shows the downhole perforation tool 100 as it is run into the wellbore 20 via downhole conveyance (or drill pipe) 55. In FIG. 2A, the downhole perforation tool 100 has been run into the wellbore 20 to a particular depth, such as at a productive subterranean formation that stores one or more hydrocarbon fluids. In FIG. 2A, the downhole perforation tool 100 is an inactivated state in that no wellbore seal, perforating gun, or valve assembly has yet to be actuated.

Figure 3A:
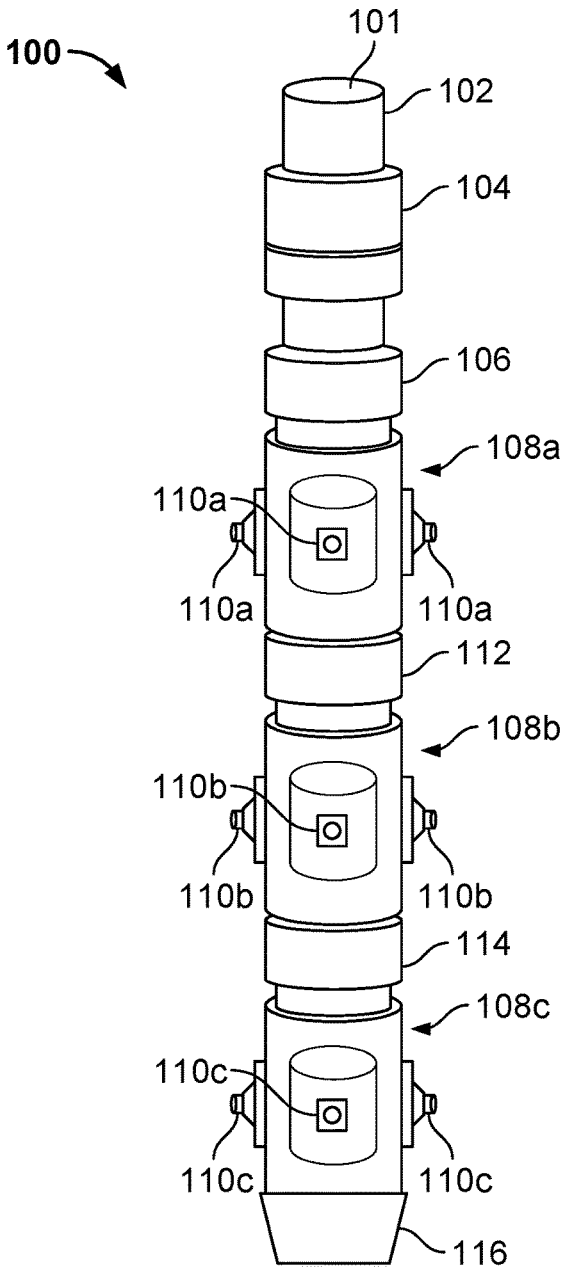
FIGS. 3A-3D are schematic illustrations of a downhole perforation tool during the wellbore operation of FIGS. 2A-2D according to the present disclosure.

Turning to FIG. 3A, this figure illustrates the downhole perforation tool 100 in an inactivated state. In this example implementation of the downhole perforation tool 100, an upper sub-assembly 102 comprises a connection (for example, threaded or otherwise) to the downhole conveyance 55 and provides a bore 101 that extends through the downhole perforation tool 100 to allow a flow of a fluid or entry of, for example, a shifting tool to actuate particular components of the downhole perforation tool 100.

Downhole of the upper sub-assembly 102 is a main wellbore seal (or main seal) 104. In some aspects, the main seal 104 comprises an inflatable or other type of main packer 104. The main packer 104, once actuated, can seal a portion of the wellbore 20 from another portion of the wellbore 20 and, generally, provide a setting mechanism to engage the production casing 35 and hold the downhole perforation tool 100 at a particular location within the wellbore 20.

In this example implementation of the downhole perforation tool 100, three perforating sub-assemblies 108*a*, 108*b*, and 108*c*, are positioned in the downhole perforation tool 100 between the main packer 104 and a lower sub-assembly 116. In this example, each perforating sub-assembly 108*a*, 108*b*, and 108*c* include one or more perforating guns 110*a*, 110*b*, and 110*c*, respectively. In this example, each perforating sub-assembly 108*a*, 108*b*, and 108*c* includes four perforating guns 110*a*, 110*b*, and 110, respectively. However, in alternate implementations, more or fewer perforating guns can be positioned in each perforating sub-assembly. Further, in alternative aspects of the downhole perforation tool 100, more or fewer than three perforating sub-assemblies can be included.

The lower sub-assembly 116, in this example, can be a cap or end to the downhole perforation tool 100. Alternatively, the lower sub-assembly 116 can include a connection (for example, threaded or otherwise) from which further downhole tools can be connected to the downhole perforation tool 100.

In the example implementation of FIG. 2A, secondary wellbore seals 106, 112, and 114 are positioned between the main seal 104 and the perforating sub-assembly 108*a*, between the perforating sub-assembly 108*a* and the perforating sub-assembly 108*b*, and between the perforating sub-assembly 108*b* and the perforating sub-assembly 108*c*, respectively. Each of the wellbore seals 106, 112, and 114 can be selectively actuated (by pressure, mechanically, or otherwise) to expand and contact the production casing 35. Thus, each perforating sub-assembly 108*a*, 108*b*, and 108*c* can be fluidly isolated (external to the downhole perforation tool 100, within the wellbore 20) from each other perforating sub-assembly 108*a*, 108*b*, and 108*c* based on the selective actuation of one or more of the wellbore seals 106, 112, and 114.

Figure 2B:
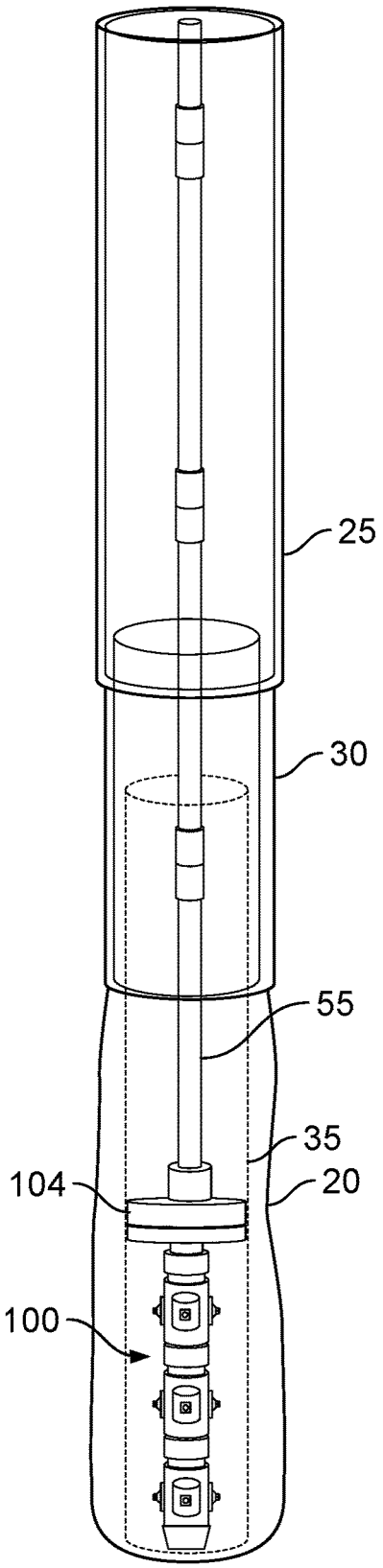
Figure 3B:
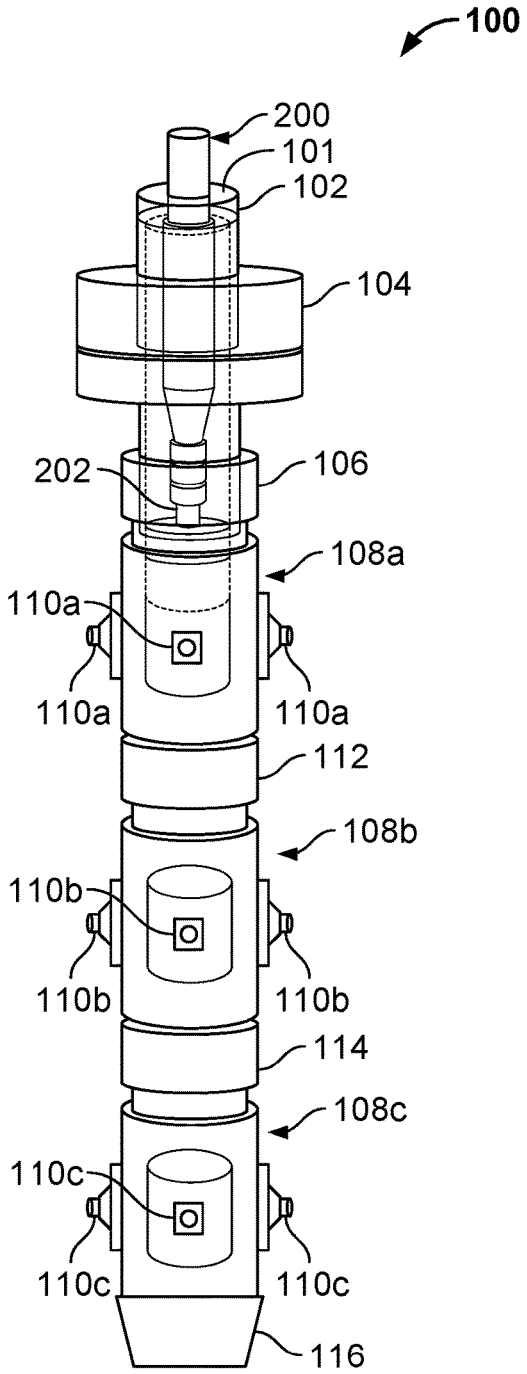

Turning to FIG. 2B, this figure shows the downhole perforation tool 100 at the particular position in the wellbore 20 and with the main packer 104 actuated to contact and seal against the production casing 35. For example, once the downhole perforation tool 100 is set at a desired depth in the wellbore 20, the main packer 104 can be actuated to set the downhole perforation tool 100 in place within the production casing 35 (but still connected to the drill string 55). FIG. 3B shows the downhole perforation tool 100 with the main packer 104 actuated. In this example, a setting tool 200 can be run into the wellbore 20 (for example, on the drill pipe 55 or otherwise) to actuate the main packer 104 with a stinger 202. As described more fully later, the stinger 202 can also actuate one or more other components of the downhole perforation tool 100 when desired.

Figure 2C:
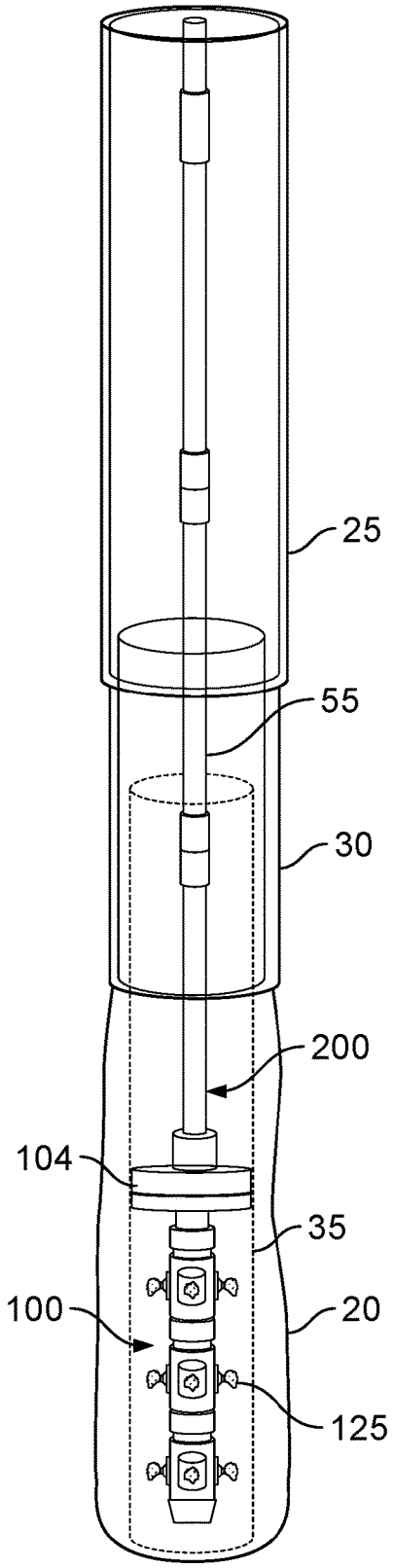
Figure 3C:
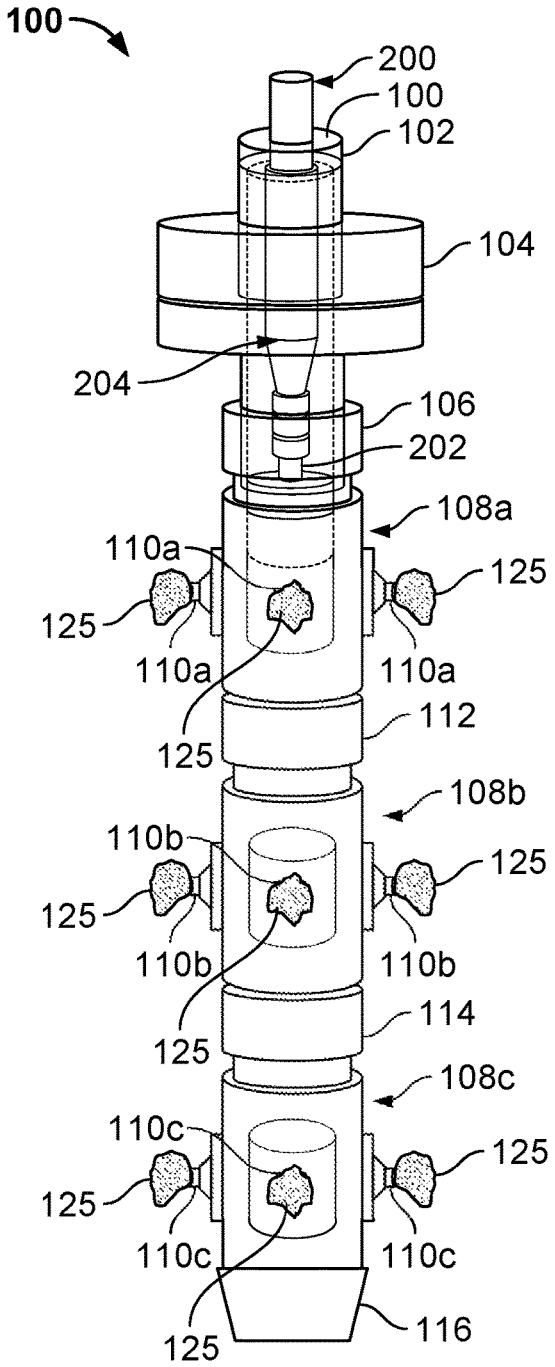

Turning to FIG. 2C, this figure shows the downhole perforation tool 100 at the particular position in the wellbore 20 and all of the perforating guns being activated to generate shots 125 to cause perforations in the production casing 35. For example, once the downhole perforation tool 100 is set at the desired depth with the main packer 104 actuated to set the downhole perforation tool 100 in place, the perforating guns (all or a portion) can be actuated. FIG. 3C shows the downhole perforation tool 100 with the main packer 104 actuated and perforating guns 110*a*, 110*b*, and 110*c* of their respective perforating sub-assemblies being activated to create shots 125. As shown in this example, the setting tool 200 can generate an activation signal 204 to activate perforating guns 110*a*, 110*b*, and 110*c*. In some aspects, the activation signal 204 can be designed to only activate a portion of the perforating guns, such as only perforating guns 110*a*, only perforating guns 110*b*, or only perforating guns 110*c* (or any combination thereof).

Figure 2D:
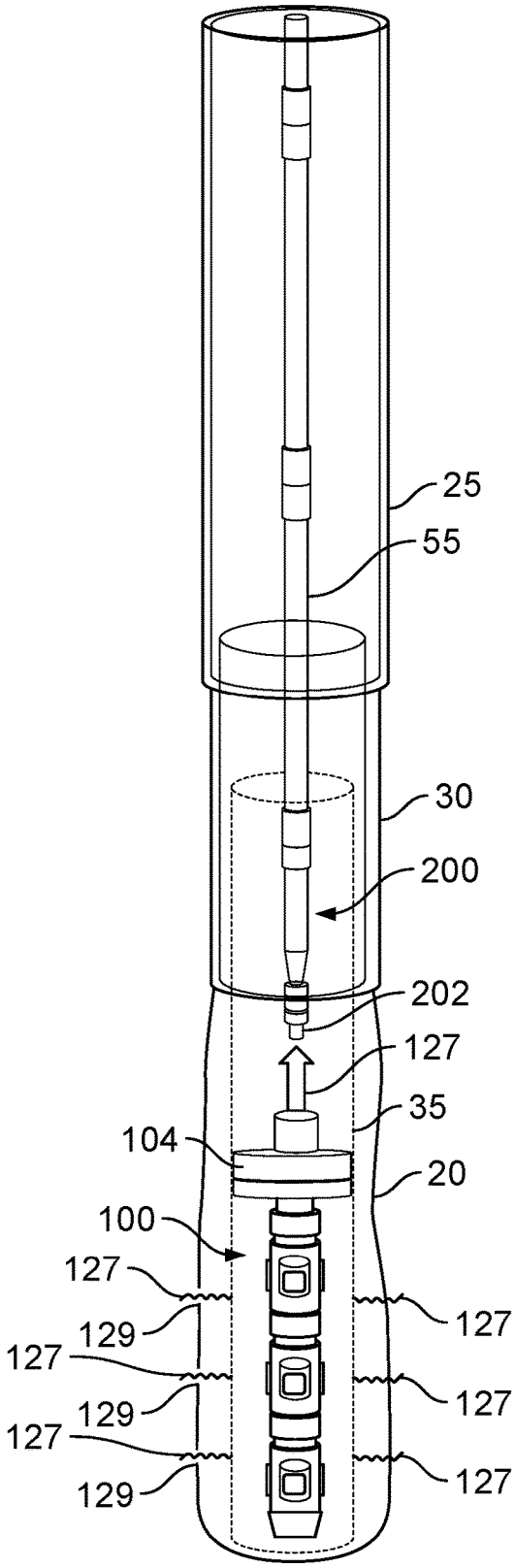

Turning to FIG. 2D, this figure shows the downhole perforation tool 100 at the particular position in the wellbore 20 having had all of the perforating guns being activated to generate shots 125 to cause perforations 129 in the production casing 35. For example, once the downhole perforation tool 100 is set at the desired depth with the main packer 104 actuated to set the downhole perforation tool 100 in place and with the perforating guns (all or a portion) actuated, wellbore fluid 127 (such as hydrocarbon fluids) can flow from the subterranean formation, through the perforations 129, and into the wellbore 20 downhole of the main packer 104. The main packer 104 can prevent wellbore fluid 127 from flowing uphole within the wellbore 20 outside of the downhole perforation tool 100 and, instead, the wellbore fluid 127 flows uphole through the downhole perforation tool 100 and into the production casing 35.

Figure 3D:
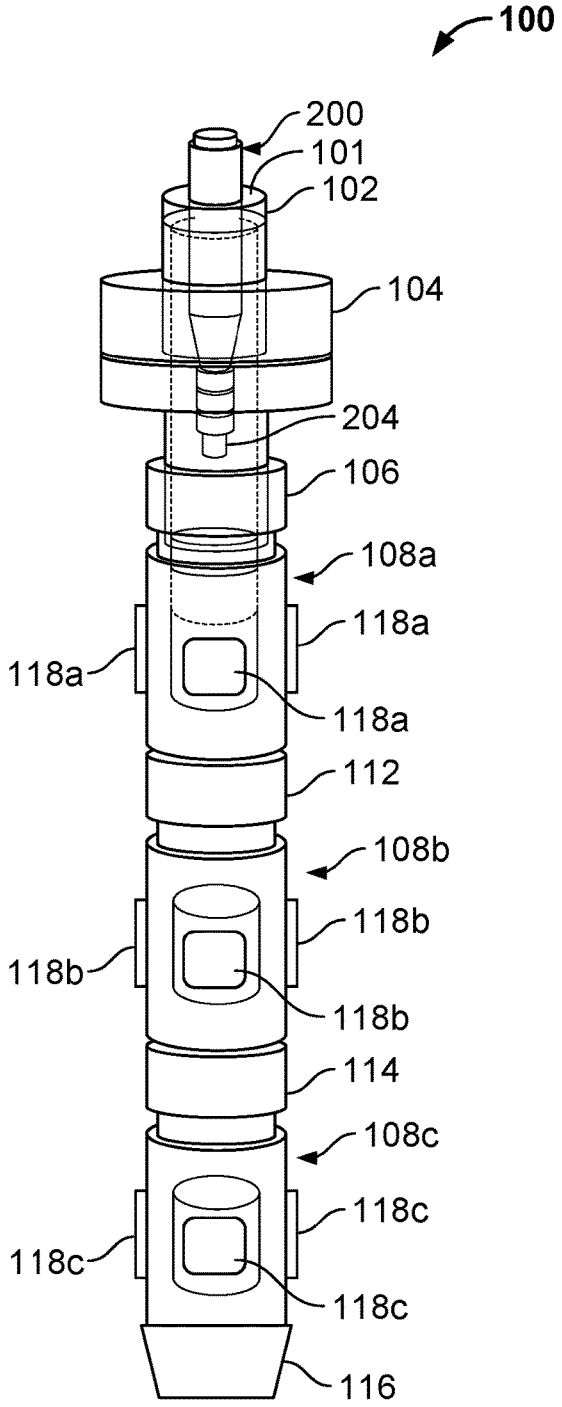

FIG. 3D shows the downhole perforation tool 100 with the main packer 104 actuated and perforating guns 110*a*, 110*b*, and 110*c* of their respective perforating sub-assemblies having been activated to create perforations 129. As wellbore fluid 127 flows into the wellbore, the stinger 202 can be removed from the downhole perforation tool 100 and ports 118*a*, 118*b*, and 118*c* on the respective perforating sub-assemblies 108*a*, 108*b*, and 108*c* can be selectively opened to allow the wellbore fluid 127 to enter the bore 101. As shown in this example, the ports 118*a*, 118*b*, and 118*c* of the respective perforating sub-assemblies 108*a*, 108*b*, and 108*c* are positioned close to or aligned with the respective perforating guns 110*a*, 110*b*, and 110*c*. Thus, after discharge of the perforating guns 110*a*, 110*b*, and 110*c*, the ports 118*a*, 118*b*, and 118*c* can be selectively opened to allow the wellbore fluid 127 to enter the bore 101.

FIGS. 4A-4D are schematic illustrations of a downhole perforation tool during the wellbore operation of FIGS. 2A-2D according to the present disclosure. For example, FIGS. 4A-4D show operation of the stinger 202 that is part of the setting tool 200 and how each set of ports 118*a*, 118*b*, or 118*c* can be selectively closed to allow selective production into the bore 101.

Figure 4A:
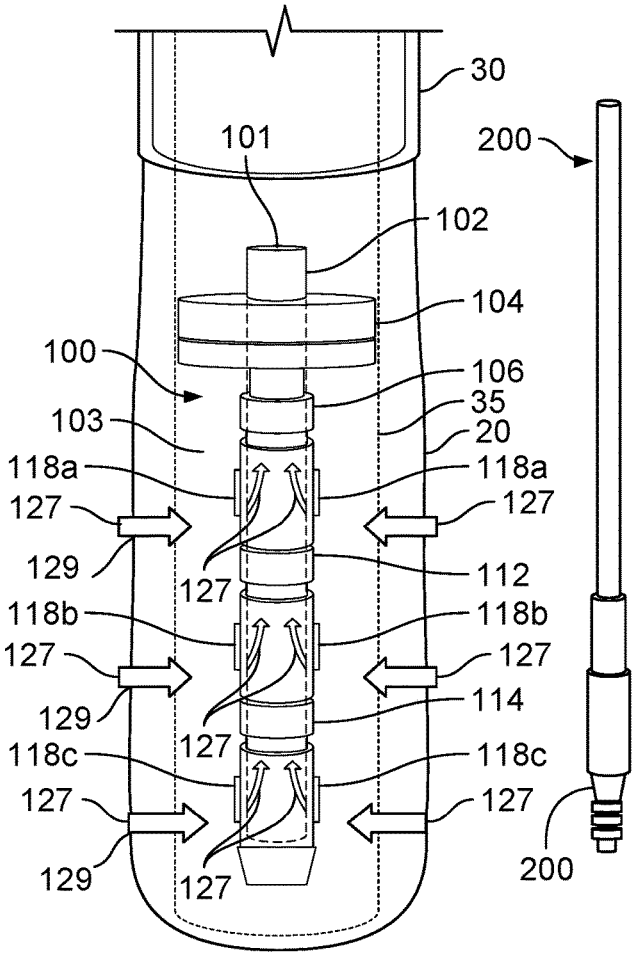
FIGS. 4A-4D are schematic illustrations of a downhole perforation tool during an operation with a shifting tool stinger according to the present disclosure.

FIG. 4A shows an example operation in which, subsequent to discharge of all of the perforating guns 110*a*, 110*b*, and 110*c*, all of the ports 118*a*, 118*b*, and 118*c* are opened to allow the wellbore fluid 127 to enter the bore 101 therethrough. Once the wellbore fluid 127 enters the bore 101, the fluid can travel uphole into the production casing 35 (or other production tubing). As shown in this operation, only the main packer 104 is actuated and set against the production casing 35, thereby forcing all wellbore fluid 127 through the bore 101 of the downhole perforation tool 100.

Figure 4B:
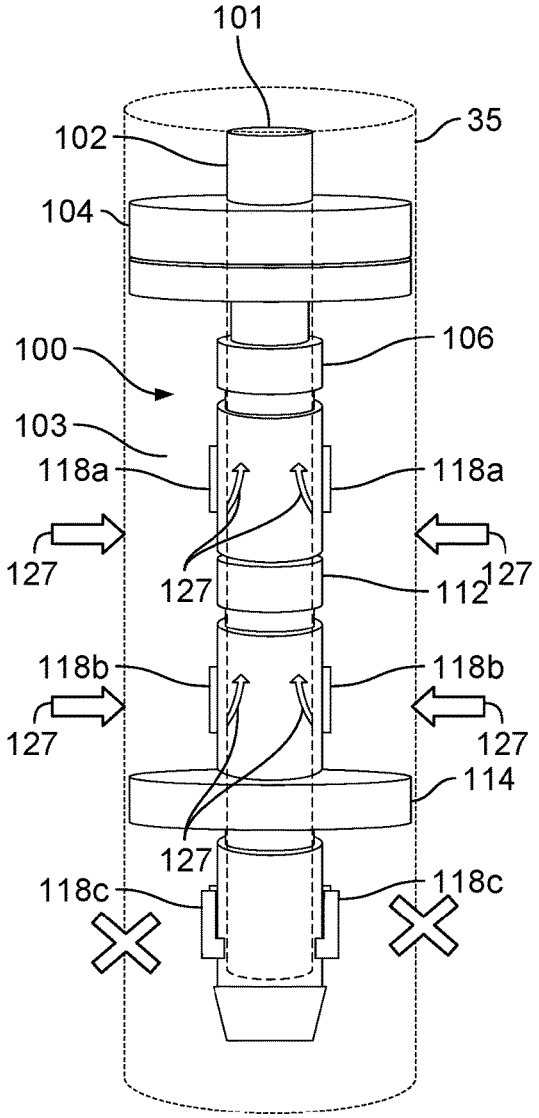

FIG. 4B shows an example operation in which the ports 118*c* of the perforation sub-assembly 108*c* are closed by the stinger 202 of the setting tool 200. In some aspects, for example, the setting tool 200 may be run into the wellbore 20 and actuate a valve assembly in the perforation sub-assembly 108*c* to close the ports 118*c*, thereby preventing wellbore fluid 127 from flowing into the ports 118*c*.

Prior to actuating the valve assembly to close the ports 118*c*, the wellbore seal 114 can be actuated to expand and seal against the production casing 35. When actuated, the wellbore seal 114 can fluidly decouple a portion of an annulus 103 of the wellbore 20 that is downhole of the wellbore seal 114 from a portion of the annulus 103 of the wellbore 20 uphole of the wellbore seal 114. Wellbore fluid 127 that enters ports 118*a* and 118*b* of perforation sub-assemblies 108*a* and 108*b*, respectively, travels uphole through the bore 101. However, wellbore fluid 127 within the wellbore 20 uphole of the wellbore seal 114 is forced to enter the ports 118*a* or the ports 118*b*.

Figure 4C:
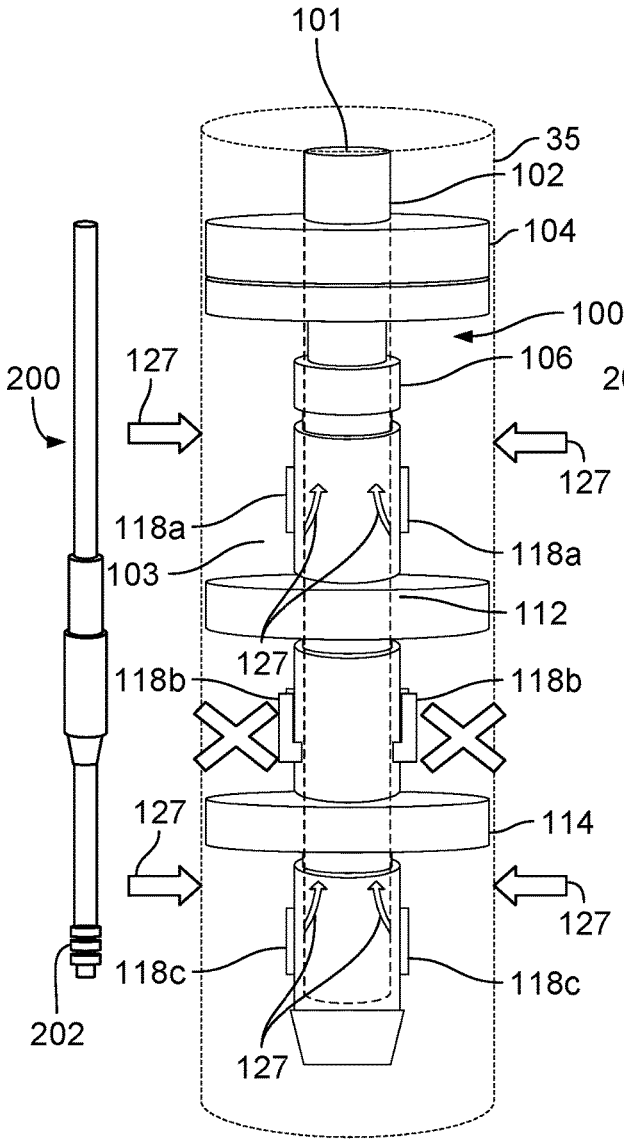

FIG. 4C shows an example operation in which the ports 118*b* of the perforation sub-assembly 108*b* are closed by the stinger 202 of the setting tool 200. In some aspects, for example, the setting tool 200 may be run into the wellbore 20 and actuate a valve assembly in the perforation sub-assembly 108*b* to close the ports 118*b*, thereby preventing wellbore fluid 127 from flowing into the ports 118*b*.

Prior to actuating the valve assembly to close the ports 118*b*, the wellbore seals 114 and 112 can be actuated to expand and seal against the production casing 35. When actuated, the wellbore seals 114 and 112 can fluidly decouple a portion of the annulus 103 of the wellbore 20 that is downhole of the wellbore seal 114 and a portion of the annulus 103 of the wellbore 20 uphole of the wellbore seal 112 from a portion of the wellbore 20 that is adjacent the perforation sub-assembly 108*b*. Wellbore fluid 127 that enters ports 118*a* and 118*c* of perforation sub-assemblies 108*a* and 108*c*, respectively, travels uphole through the bore 101. However, wellbore fluid 127 may not enter the wellbore 20 adjacent the perforation sub-assembly 108*b*.

Figure 4D:
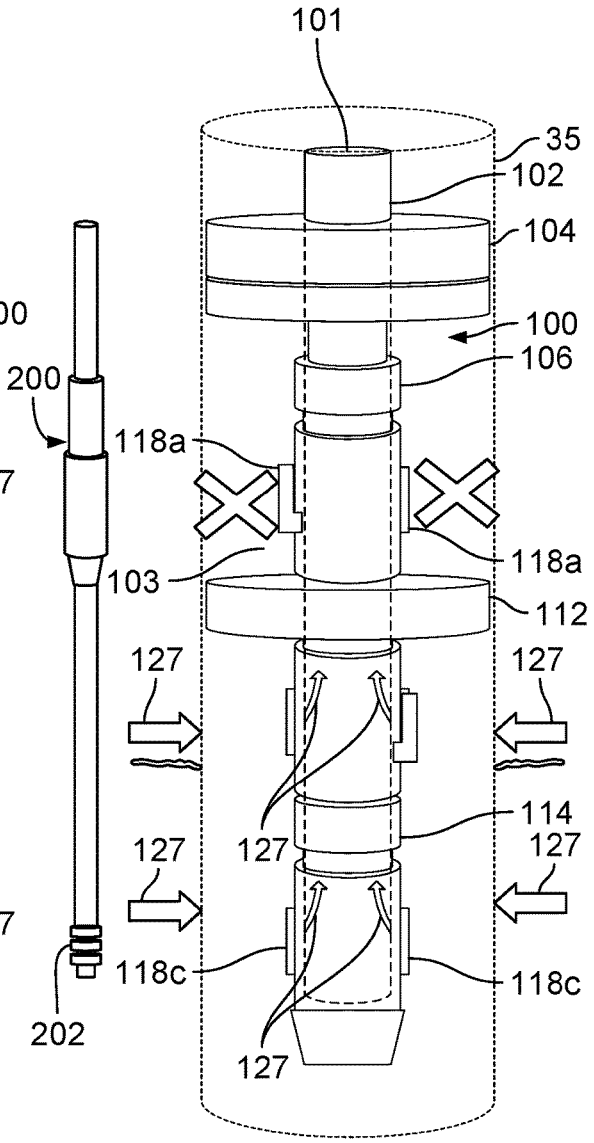

FIG. 4D shows an example operation in which the ports 118*a* of the perforation sub-assembly 108*a* are closed by the stinger 202 of the setting tool 200. In some aspects, for example, the setting tool 200 may be run into the wellbore 20 and actuate a valve assembly in the perforation sub-assembly 108*a* to close the ports 118*a*, thereby preventing wellbore fluid 127 from flowing into the ports 118*a*.

Prior to actuating the valve assembly to close the ports 118*a*, the wellbore seal 112 (and in some aspects, wellbore seal 106) can be actuated to expand and seal against the production casing 35. When actuated, the wellbore seal 112 (in combination with the actuated main packer 104 or the actuated wellbore seal 106, or both) can fluidly decouple a portion of the annulus 103 of the wellbore 20 that is downhole of the wellbore seal 112 from a portion of the annulus 103 of the wellbore 20 that is uphole of the wellbore seal 112. Wellbore fluid 127 that enters ports 118*b* and 118*c* of perforation sub-assemblies 108*b* and 108*c*, respectively, travels uphole through the bore 101. However, wellbore fluid 127 may not enter the wellbore 20 adjacent the perforation sub-assembly 118*a*.

Figure 5C:
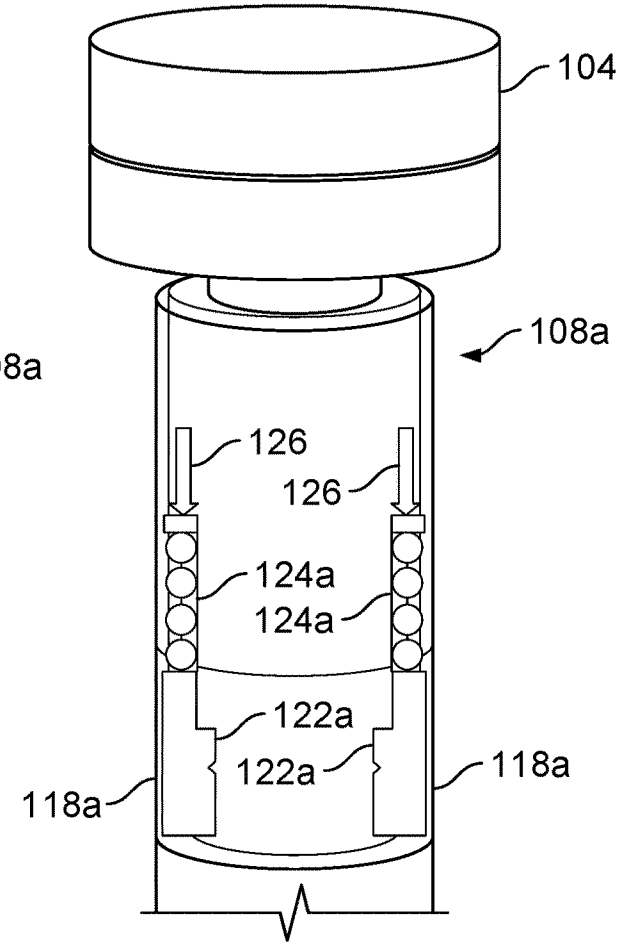
FIGS. 5A-5C are schematic illustrations of a downhole perforation tool during an operation of a valve assembly of the tool according to the present disclosure.
Figure 5B:
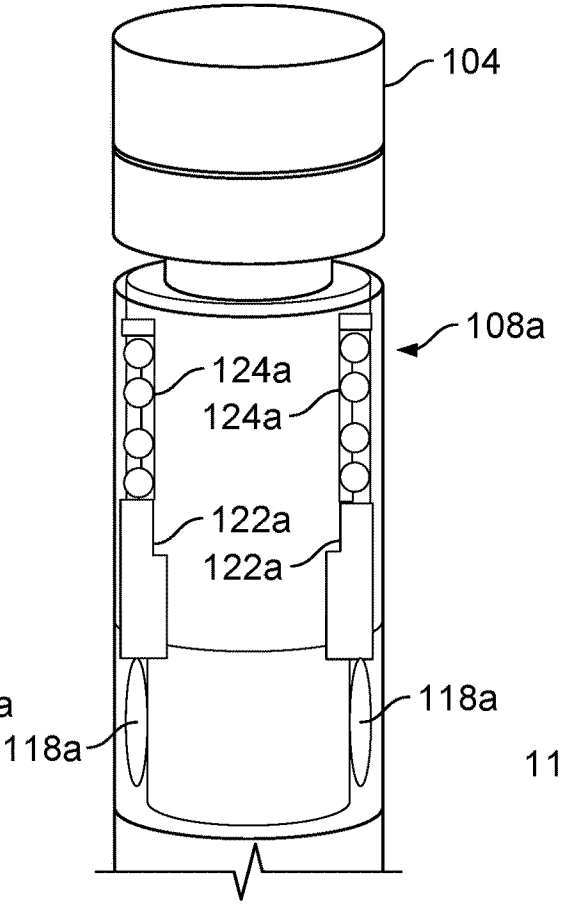
Figure 5A:
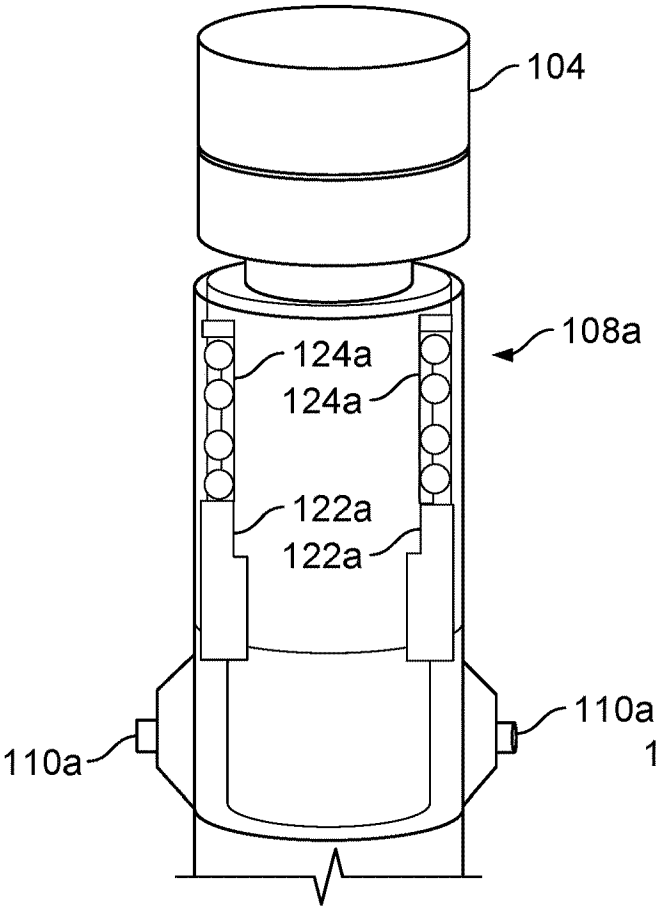

FIGS. 5A-5C are schematic illustrations of the downhole perforation tool 100 during an operation of a valve assembly of the tool 100 according to the present disclosure. For example, as described with reference to FIGS. 4A-4D, one or more valve assemblies of the perforation sub-assemblies 108*a*, 108*b*, and 108*c* can be operated to close the ports 118*a*, 118*b*, and 118*c*, respectively. Turning to FIG. 5A, a portion of the downhole perforation tool 100 that includes the perforation sub-assembly 108*a* is shown (in cross-section). In this example implementation, a valve assembly of the perforation sub-assembly 108*a* includes one or more port covers 122*a* and one or more spring assemblies 124*a* that abut an uphole end of the one or more port covers 122*a*. In FIG. 5A, the perforation sub-assembly 108*a* is shown prior to activation of the perforating guns 110*a*.

Turning to FIG. 5B, the perforation sub-assembly 108*a* is shown after activation of the perforating guns 110 and opening of the ports 118*a*. In some aspects, ports 118*a* in an open state after activation of the perforating guns 110*a* (for example, due to initiation of an explosive charge or charges in each perforating gun 110*a* to expose the ports 118*a*). As shown in FIG. 2B, the ports covers 122*a* are positioned uphole of the ports 118*a*, thereby allowing wellbore fluid to enter the ports 118*a* from the wellbore.

FIG. 5C shows the perforation sub-assembly 108*a* after operation of the valve assembly to urge the port covers 122*a* over the ports 118*a*, thereby preventing wellbore fluid from entering the ports 118*a* from the wellbore. In this example, a force 126 is applied to the spring assemblies 124*a* to urge the spring assemblies 124*a* in a downhole direction (in other words, away from the main packer 104 and toward the ports 118*a*). As the spring assemblies 124*a* are urged in the downhole direction, they push the port covers 122*a* to cover the ports 118*a* as shown.

Figures 6A, 6B, 6C:
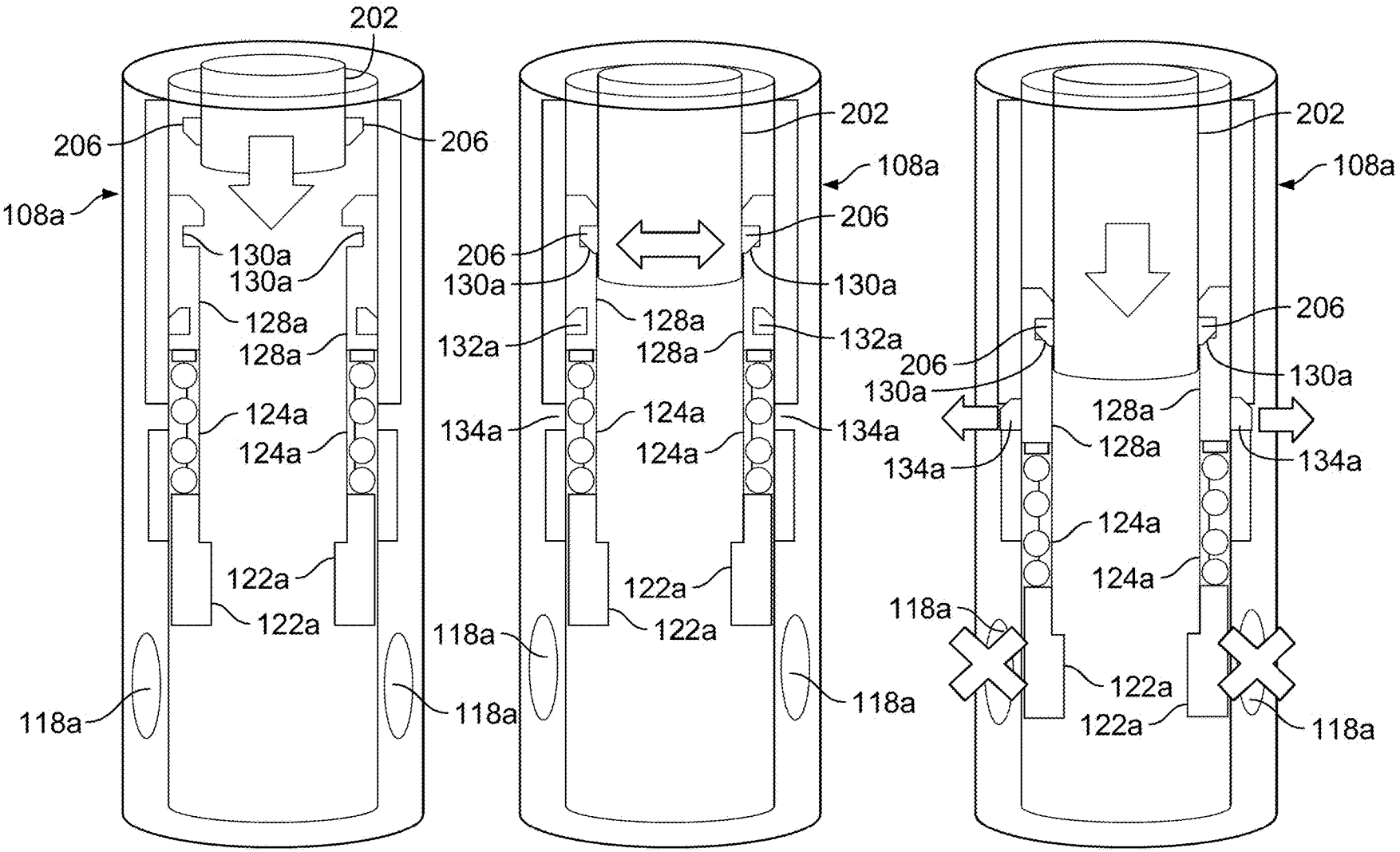
FIGS. 6A-6D are further schematic illustrations of a downhole perforation tool during an operation of a valve assembly of the tool according to the present disclosure.

Turning to FIGS. 6A-6D, these figures show schematic illustrations of an example operation of the valve assembly described in FIGS. 5A-5C. Like FIGS. 5A-5C, in this example, the operation of the valve assembly of the perforation sub-assembly 108*a* is described; however, this description could also be applied to valve assemblies of the perforation sub-assemblies 108*b* and 108*c*. As shown in FIG. 6A, the stinger 202 can include one or more keys 206 that are configured to fit within matching profiles 130*a* formed on sleeves 128*a* positioned within the perforation sub-assembly 108*a* uphole of spring assemblies 124*a* (which are positioned uphole of the port covers 122*a*). As shown in FIG. 6A, the ports 118*a* are open, and the stinger 202 is being moved in a downhole direction into the perforation sub-assembly 108*a* (in other words, into the bore 101 of the perforation sub-assembly 108*a*).

Figure 7A:
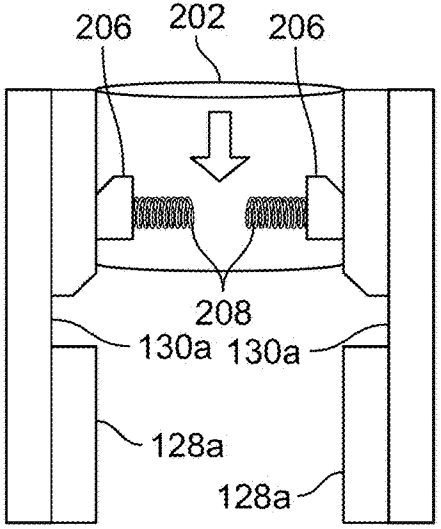
FIGS. 7A-7B are further schematic illustrations of a downhole perforation tool during an operation of a valve assembly of the tool according to the present disclosure.
Figure 7B:
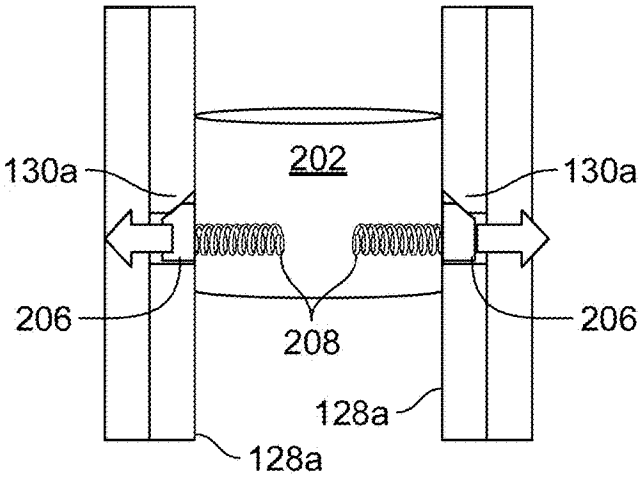

Turning to FIG. 6B, as this figure shows, once the stinger 202 is moved into the perforation sub-assembly 108*a* a sufficient distance, the keys 206 snap into the profiles 130*a*, thereby coupling the sleeves 128*a* with the stinger 202. Turning briefly to FIGS. 7A-7B, these figures further illustrate the coupling of the stinger 202 with the sleeves 128*a*. For example, as shown, springs 208 within the stinger 202 are positioned to urge the keys 206 radially outward from the stinger 202. As the stinger 202 is moved through the sleeves 128*a* (as shown in FIG. 7A), the keys 206 eventually reach the profiles 130*a*. Once the keys 206 reach the profiles 130*a*, springs 208 urge the keys 206 to snap into the profiles 130*a* as shown in FIG. 7B. In some aspects, the stinger 202 can pull the keys 206 from the profiles 130*a*, such as to disengage the stinger 202 from the downhole perforation tool 100.

Figure 6D:
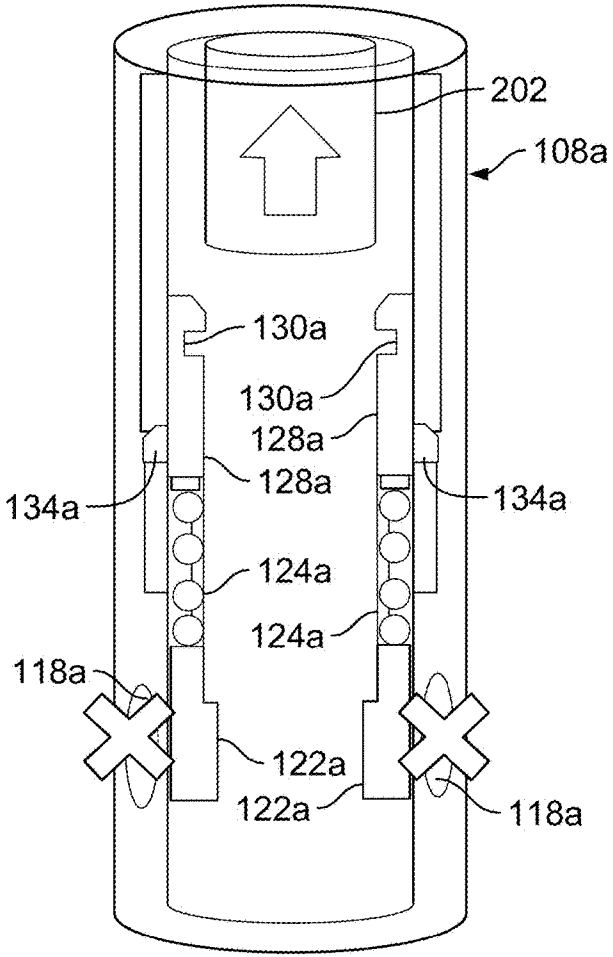

Turning to FIG. 6C, this figure illustrates the stinger 202 coupled with the sleeves 128*a*, and the sleeves 128*a* pushing the port covers 122*a* down to cover ports 118*a*. In this example, the sleeves 128*a* also include profiles 132*a* that, when aligned with keys 134*a* formed in the perforation sub-assembly 108*a*, receive the keys 134*a* to hold the port covers 122*a* in position as shown in FIG. 6C. Once the port covers 122*a* are in place as shown in FIG. 6C, the stinger 202 can be decoupled from the sleeves 128*a* and, for example, run out of the wellbore 20 as shown in FIG. 6D.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole perforation tool, comprising:

an upper sub-assembly configured to couple to a downhole conveyance within a wellbore tubular installed in a wellbore that is formed from a terranean surface toward a subterranean formation;

a plurality of perforation sub-assemblies, each perforation sub-assembly comprising:

one or more perforation guns configured to initiate an explosive charge, each of the one or more perforation guns configured to activate based on an activation signal provided by a stinger tool run into the wellbore through the wellbore tubular and separately from the upper sub-assembly;

one or more ports configured to fluidly couple the wellbore with a bore that extends from the one or more ports to the upper sub-assembly to receive a wellbore fluid from the subterranean formation, through the one or more ports, and into the bore;

one or more port covers configured to move between a first position such that the one or more ports is open to the wellbore to fluidly couple the wellbore with the bore and a second position such that the one or more ports is closed to the wellbore to fluidly decouple the wellbore from the bore;

for each port cover, a sleeve positioned uphole of the port cover; and for each port cover, at least one spring positioned between the sleeve and the port cover and to abut an uphole end of the port cover, the spring biased to urge the port cover toward the first position;

a main wellbore seal positioned between the upper sub-assembly and the plurality of perforation sub-assemblies, the main wellbore seal actuatable to anchor the downhole perforation tool to a casing in the wellbore; and at least one secondary wellbore seal positioned between adjacent perforation sub-assemblies of the plurality of perforation sub-assemblies, the at least one secondary wellbore seal actuatable to fluidly isolate a portion of an annulus of the wellbore from another portion of the annulus of the wellbore.

2. The downhole perforation tool of claim 1, wherein the plurality of perforation sub-assemblies comprise at least three perforation sub-assemblies, and the at least one secondary wellbore seal comprises a first secondary wellbore seal positioned between a first pair of the at least three perforation sub-assemblies and a second secondary wellbore seal positioned between a second pair of the at least three perforation sub-assemblies.

3. The downhole perforation tool of claim 2, wherein each of the one or more perforation guns is configured to activate based on an activation signal provided by a stinger tool run into the wellbore.

4. The downhole perforation tool of claim 3, wherein the one or more port covers is configured to move from the first position to the second position based on engagement of the sleeve of one or more sleeves, that abuts the one or more port covers through the spring of one or more springs, with the stinger tool to move the one or more sleeves toward the one or more ports.

5. The downhole perforation tool of claim 4, wherein the one or more sleeves comprises a profile configured to engage a key on the stinger tool.

6. The downhole perforation tool of claim 5, wherein the key on the stinger tool is biased by a spring to engage the profile.

7. The downhole perforation tool of claim 5, wherein the stinger is configured to pull the key from the profile to disengage the stinger tool from the one or more sleeves.

8. The downhole perforation tool of claim 7, wherein the key is one of two keys radially spaced on the stinger tool.

9. The downhole perforation tool of claim 8, wherein the two keys are radially spaced 180 degrees apart on the stinger tool.

10. The downhole perforation tool of claim 3, wherein the one or more secondary wellbore seals comprises a packer.

11. The downhole perforation tool of claim 3, wherein the main wellbore seal comprises an inflatable packer.

12. The downhole perforation tool of claim 1, wherein the one or more port covers is configured to move from the first position to the second position based on engagement of the sleeve of one or more sleeves, that abuts the one or more port covers through the spring of one or more springs, with the stinger tool to move the one or more sleeves toward the one or more ports.

13. The downhole perforation tool of claim 12, wherein the one or more sleeves comprises a profile configured to engage a key on the stinger tool.

14. The downhole perforation tool of claim 13, wherein the key on the stinger tool is biased by a spring to engage the profile.

15. The downhole perforation tool of claim 14, wherein the one or more secondary wellbore seals comprises a packer.

16. The downhole perforation tool of claim 15, wherein the main wellbore seal comprises an inflatable packer.

17. The downhole perforation tool of claim 13, wherein the stinger tool is configured to pull the key from the profile to disengage the stinger tool from the one or more sleeves.

18. The downhole perforation tool of claim 17, wherein the key is one of two keys radially spaced on the stinger tool.

19. The downhole perforation tool of claim 1, wherein the one or more secondary wellbore seals comprises a packer.

20. The downhole perforation tool of claim 1, wherein the main wellbore seal comprises an inflatable packer.

* * * * *